United States Patent [19]

Gazda et al.

[11] 4,023,620

[45] May 17, 1977

[54] NO-GO BOMB HANGER

[75] Inventors: Imre I. Gazda, Saginaw; Albert W. Carroll, Dallas, both of Tex.

[73] Assignee: Otis Engineering Corporation, Dallas, Tex.

[22] Filed: Feb. 17, 1976

[21] Appl. No.: 658,460

[52] U.S. Cl. ..... 166/217
[51] Int. Cl.² ..... E21B 23/00
[58] Field of Search ..... 166/217

[56] References Cited

UNITED STATES PATENTS

| | | | |
|---|---|---|---|
| 3,002,565 | 10/1961 | Moore, Jr. | 166/217 |
| 3,593,784 | 7/1971 | Brown | 166/217 |
| 3,863,715 | 2/1975 | Yonker | 166/217 |

FOREIGN PATENTS OR APPLICATIONS

| | | | |
|---|---|---|---|
| 704,843 | 3/1965 | Canada | 166/217 |

*Primary Examiner*—James A. Leppink

*Attorney, Agent, or Firm*—Warren H. Kintzinger

[57] ABSTRACT

A well tubing hanger for suspending a pressure bomb and/or temperature recording device, or other equipment in the tubing from a tubing no-go nipple, through a test period. It is a bomb hanger such that when the suspended equipment is being used for test surveys, the wire line used to run the tools is not left in the well. This results in considerable savings; particularly when a plurality of wells in a field are being surveyed. Tubing hanger locking lugs are shifted radially outwardly into a nipple recess by a longitudinal, movable camming and lug-locking tubular sleeve extension from the tool fishing neck, with the sleeve lockable by a ball recess lock interference fit. A resiliently displaceable plunger structure permits a recess relief unlock for the balls, from the ball recess lock interference fit and thereby permits unlock release movement of said tubular sleeve, with the tool fishing neck, for unlocking the locking lugs from the extended state.

31 Claims, 13 Drawing Figures

NO-GO BOMB HANGER

Figure 1:
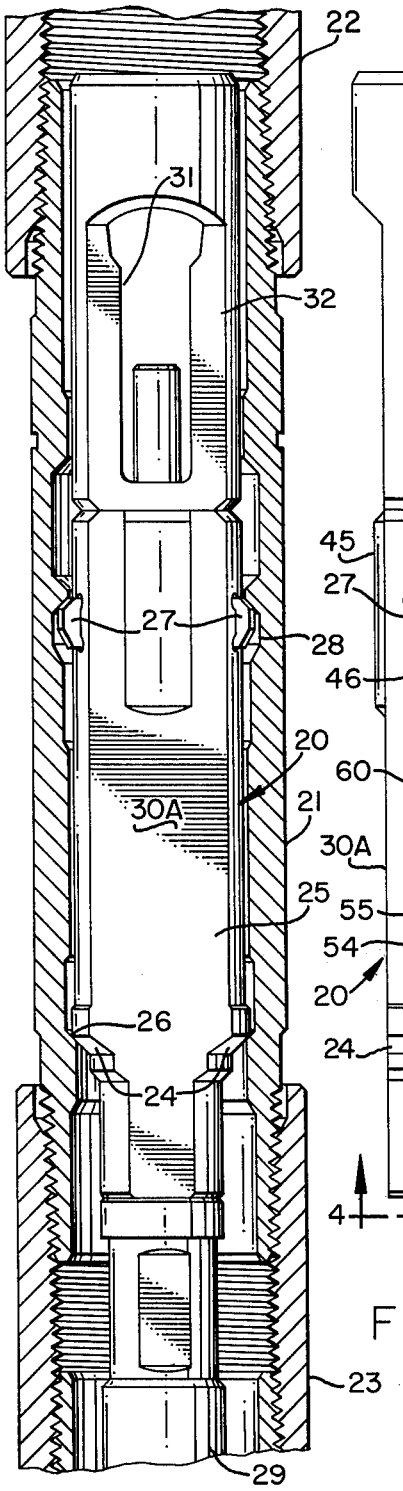

This invention relates in general to well tools, and in particular to an improved well tubing hanger in the form of a no-go bomb hanger generally used for suspending the sensing equipment, such as a pressure bomb for pressure surveys, in well tubing.

In wells drilled for the recovery of oil and/or gas, various tools such as pressure and/or temperature survey tools are suspended from hangers (i.e,. bomb hangers) when wireline, use to run the tools, is not left in the hole. This feature is particularly useful with well producers requiring extended draw-down, or build-up, bottom hole pressure surveys, with a lug-type bomb hanger suspending the pressure and/or temperature bomb in the tubing during the test. Such bomb hanger usage results in considerable savings over methods wherein wireline is left in the hole through a measuring test time period, particularly when several wells in a field are to be surveyed. Obviously, it is important that a bomb hanger be left in a well, only if it is properly set in the well—and usage is enhanced if for example a no-go bomb hanger is settable in a standard well tubing no-go nipple. Further, bomb hanger structure should advantageously be such as to provide for optimized bypass flow and to facilitate lowering through fluid down the well. It is also important that wireline-run, no-go bomb hangers be lockable in place through utilization of weight of the tool string, and that the bomb hanger be removable without jarring.

It is therefore a principal object of this invention to provide a down well, no-go equipment hanger capable of being locked in place, and removed, without jarring sensitive tools and equipment supported by the hanger.

Another object is to provide such a no-go hanger, lockable in place through utilization of tool string weight.

A further object is to provide such a no-go hanger, configured for optimized fluid bypass flow when locked in place, and for facilitating lowering through fluid down the well.

Still another object is to provide a no-go hanger, settable in a standard no-go well tubing nipple, that is left in the well, with wireline and running tool removed, only if properly set.

Features of this invention useful in accomplishing the above objects include, in a no-go equipment hanger (i.e., bomb hanger), a hanger unit that is wireline run with a disengageable running tool until it comes to rest on a no-go shoulder in a well tubing nipple. Then with some additional play out of wireline, weight of the running tool shifts a fishing neck member of the bomb hanger downward, in the hanger structure against resilient resistive force of an internal spring member, through a finite range of movement until lock position balls are cammed outwardly into ball retainer seats as a lock member is spring-urged upward into a lock-retaining state. As the fishing neck member is shifted downward, lugs are cammed outward and then maintained in the lock-extended state, in set position, maintaining locked engagement in an annular recess of a tubing nipple. Thereafter, the wireline, with sufficient lifting force, disengages the running tool from the fishing neck of the no-go bomb hanger, which remains set-in-place in the well. When the bomb hanger and hanger-suspended tooling is to be removed from the well, a pulling tool lowered by wireline presses the lock member downward against the resilient force of the spring member. The lock member is moved down until the lock position balls cam out of the ball retainer lock seats, with upward movement of the fishing neck member to a position permitting inward camming withdrawal of the lugs from the outward position lock position. Then the pulling tool latch engaged in the fishing neck with upward pulling of the wireline withdraws the bomb hanger and the hanger-suspended tooling up the well.

A specific embodiment representing what is presently regarded as the best mode for carrying out the invention is illustrated in the accompanying drawings.

Figure 2:
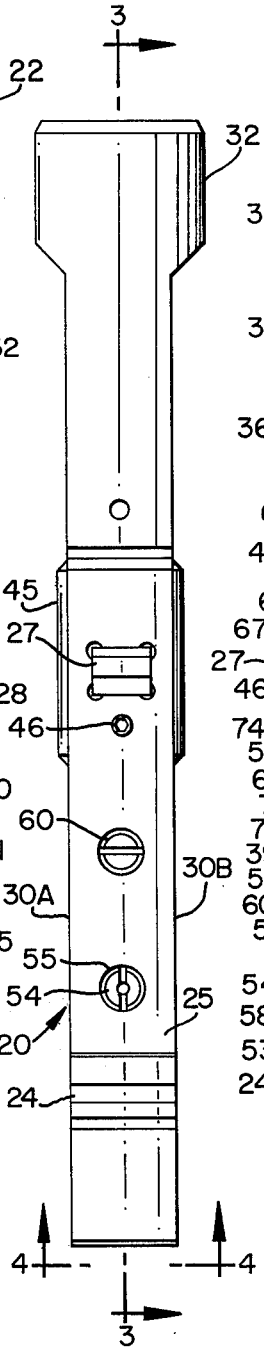
Figure 3:
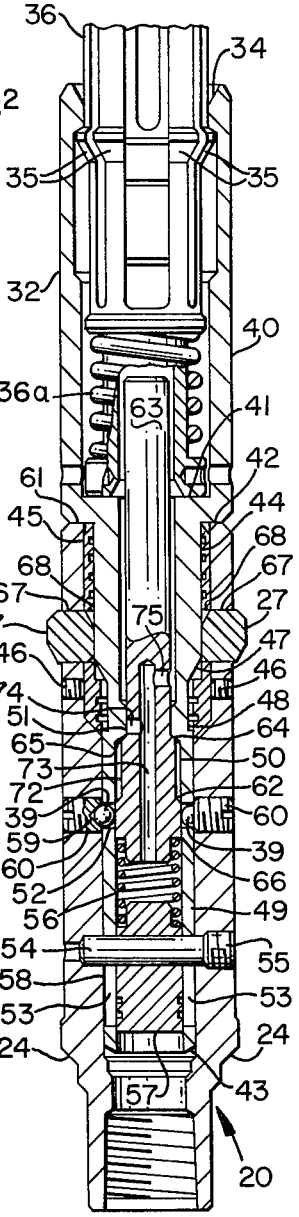
Figure 4:
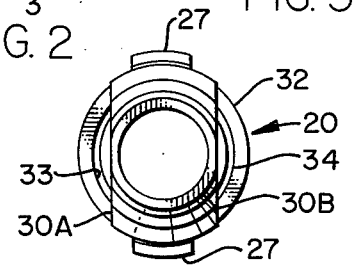
Figure 5:
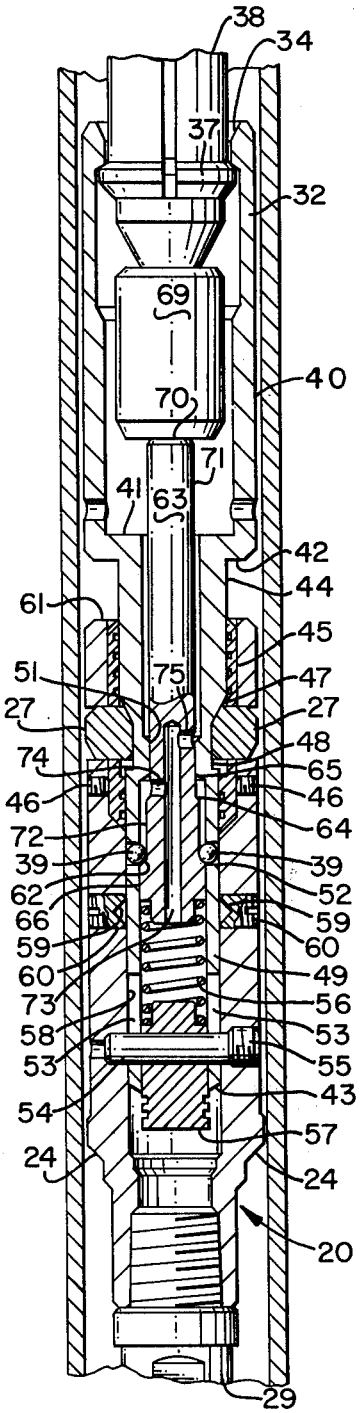
Figure 6:
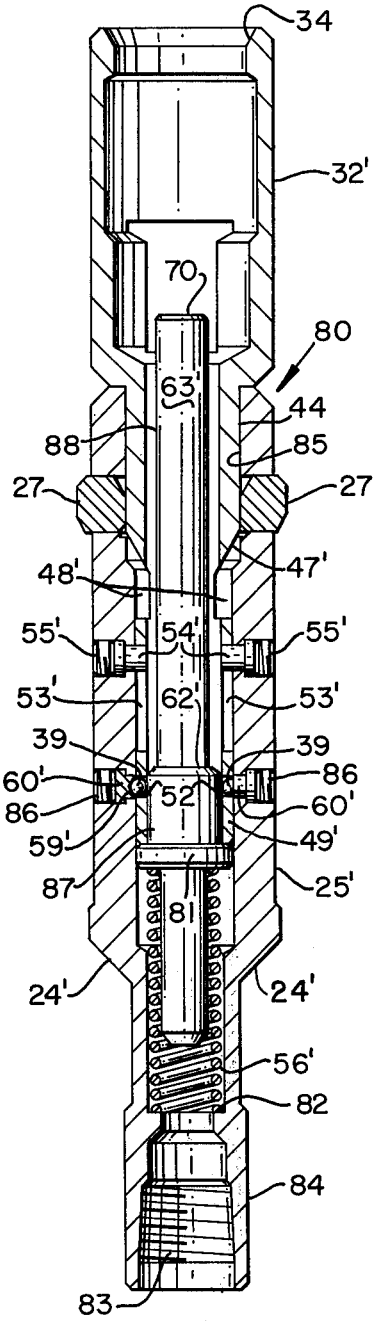
Figure 7:
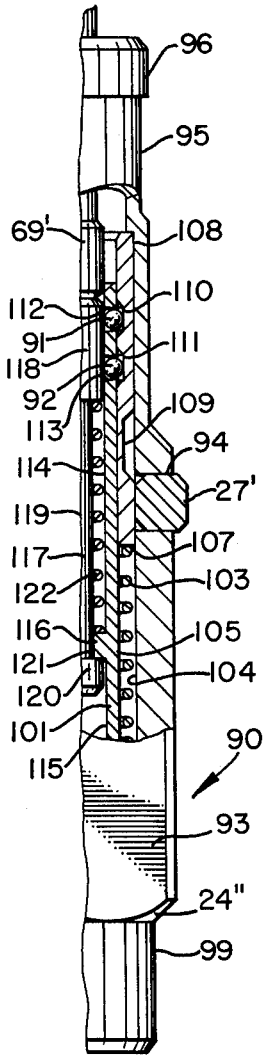
Figure 9:
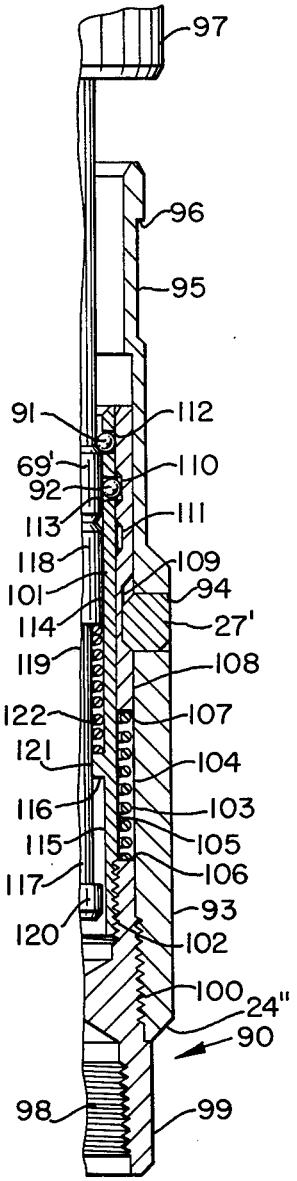
Figure 8:
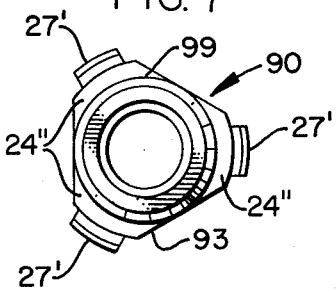
Figure 10:
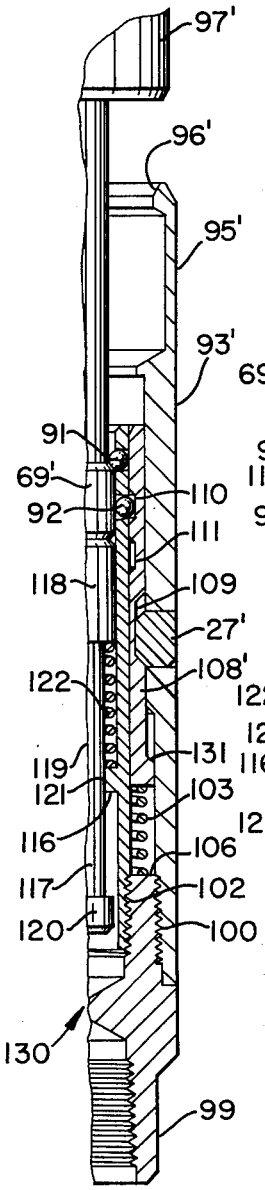
Figure 11:
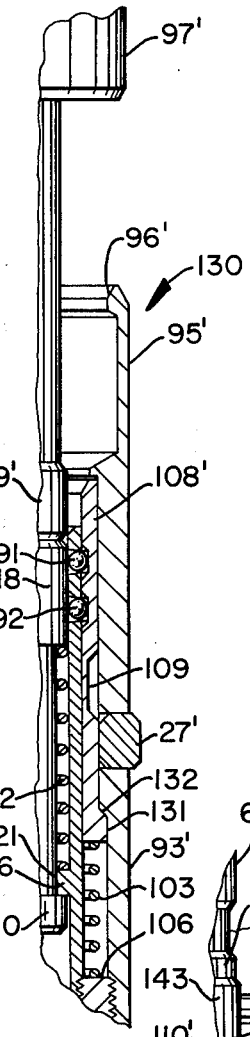
Figure 13:
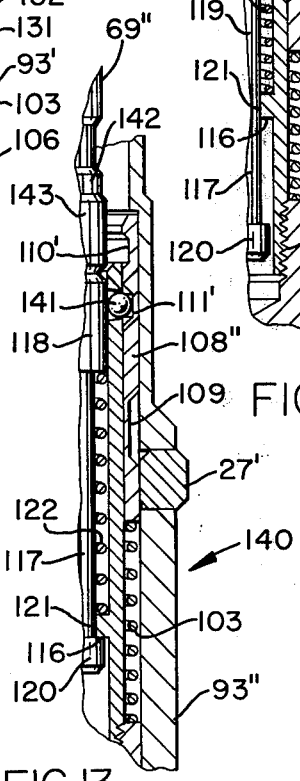
Figure 12:
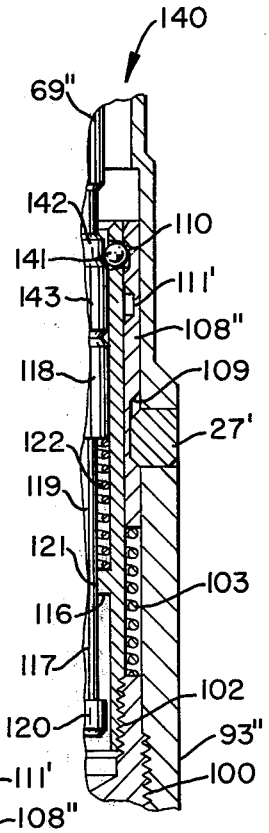

In the drawings:

FIG. 1 represents a side elevation view of a no-go bomb hanger, set in place in a no-go nipple, with well tubing and nipple broken away and sectioned;

FIG. 2, a side elevation of the no-go bomb hanger of FIG. 1, by itself, rotated 90°;

FIG. 3, a side elevation view of applicants' no-go bomb hanger, in section, substantially along line 3 — 3 of FIG. 2, with a running tool still inserted into the fishing neck of the bomb hanger and lugs lock-extended;

FIG. 4 a bottom view of the bomb hanger, looking upward from line 4 — 4 of FIG. 2;

FIG. 5, a side elevation sectioned view much like FIG. 3, with, however, a wireline pulling tool inserted in the fishing neck of the bomb hanger, and lugs retracted for retreival removal of the bomb hanger, and the tool string suspended therefrom;

FIG. 6, a side elevation sectioned view much like FIG. 3, of another no-go bomb hanger embodiment, similar in many respects to the embodiment of FIG. 1 through 5, with lugs lock-extended;

FIG. 7, a partial side elevation view of still another bomb hanger embodiment, with a portion broken away and sectioned to show interior detail with lugs lock-extended;

FIG. 8, a bottom view of the embodiment of FIG. 7, showing the unit to be a three-lug bomb hanger;

FIG. 9, a partial side elevation, in section, like FIG. 7, with, however, the lugs retracted from the lock-extended state;

FIG. 10, a partial side elevation, in section, like FIG. 9, of another embodiment, similar in many respects to the embodiment of FIGS. 7, 8, and 9;

FIG. 11, a partial side elevation view, in section, of the no-go bomb hanger of FIG. 10, with lugs lock-extended; and, FIGS. 12 and 13, partial side elevations of yet another no-go bomb hanger with, respectively, the lugs retracted and in the lock-extended state.

Referring to the drawings:

The no-go bomb hanger 20 of FIGS. 1 through 5 is shown in FIG. 1 to be set in a well no-go nipple 21, threadedly interconnected between upper tubing member 22 and lower tubing member 23. In the set state shown, shoulders 24 of hanger housing 25 are in no-go engagement, resting on internal annular boss shoulder 26 of nipple 21, and hanger position set lugs 27 project outward into annular nipple recess 28, locking the bomb hanger 20 from upward movement from this set state in the well. When the no-go bomb hanger is so set in the well, nipple shoulder 26 supports the weight of the hanger 20 and tooling equipment 29, supported thereby. The bomb hanger 20 is also so configured to optimize bypass flow of oil and/or gas, with flat sides 30A and 30B, and openings 31, through opposite sides of fishing neck 32, to a center opening 33 therein, extending to and through an upper end annular internal beveled boss 34. Boss 34 is engaged by locking projections 35 of a running tool 36, such as the "Soft Set Running Tool," subject of U.S. Patent application Ser. No. 647,341, filed Jan. 8, 1976, with a co-inventor of this case being a co-inventor thereof, and both cases being assigned to common assignee. The upper end annular internal beveled boss 34 in fishing neck member 32 is also engaged by locking projections 37 of a wireline pulling tool 38, when upward wireline removal of the bomb hanger 20 and tool equipment 29 is undertaken. While the bomb hanger 20 is in the withdrawal state in FIG. 5, being raised by a pulling tool 38, the relative positions of the fishing neck member 32, lock position balls 39, lugs 27, and housing member 25, are the same as when the bomb hanger 20 is being lowered by wireline running tool 36, before shoulders 24 engage nipple shoulder 26; after which, weight of the running tool 36 shifts the fishing neck member 32 downward relative to housing member 25.

Fishing neck member 32 is formed to have an enlarged upper hollow cylindrical portion 40, within which running tool 36 or a pulling tool 38, may be engaged, terminating in a bottom end having an internal bottom surface 41, and an outer shoulder 42. A tubular downward extension 43, from the cylinder 40, is formed with an enlarge diameter shank 44, slidingly received within a sand catcher sleeve bearing 45, inserted in the upper end of hanger housing 25 and held in place therein by set screws 46. Shank 44 terminates in a lower end 30° sloped, conical cam surface 47, extended to a reduced diameter section 48 that permits retraction of lugs 27-to the withdrawn, unlocked state shown in FIG. 5. The extension 43 also includes a bottom tube section 49 that has a larger internal diameter 50 than the reduced internal diameter 51 within extension section 48. Bottom tube section 49 has ball openings 52 acting as a retainer cage for lock balls 39, and is also provided with slots 53 that cooperate with a guide and limit pin 54, mounted to extend from one side to the other of the housing member 25, with a head 55 threaded into housing 25. Guide and limit pin 54 not only extends through slots 53 of the tube 49, but also mounts a spring 56 retainer member 57, longitudinally fixed thereby to housing 25, but slidable within internal diameter 51 of tube 45 as the tube 49 is slid longitudinally back and forth within the cylindrical portion 58 of housing 25. Slots 53, in tube 49, limit the range of longitudinal movement of the fishing neck member 32, relative to housing 25, between a position limit shown in FIG. 5 and the opposite limit set state position of FIG. 3, by contact of respective slot ends with guide and limit pin 54. Further, the sides of tube slots 53, in sliding on opposite sides of pin 54, maintain rotational alignment of the tube 49 and fishing neck 32 with hanger housing 25. This insures that lock position balls 39 will be delivered for proper cammed entry to the conical receiving relief openings 59 in ball retainers 60, threaded into housing 25, when the fishing neck 32 and tube 49 are shifted down to the lock set state limit position of FIG. 3, with shoulder 42 adjacent housing top 61 and pin 54 at the top of slots 53. When this lock set state is reached, balls 39 are cammed outwardly by sloped annular cam surface 62 of lock member 63 that is resiliently urged upward by coil spring 56, compressed between the bottom of block member 63 and the top of spring retainer member 57. Lock member 63 is carried down, with tube 49, by the interlock through-balls 39 between tube 49 and member 63, via cam surface 62. Then when balls 39 are cammed outwardly into retainer openings 59, lock member 63 shifts upward to a limit position, with lock member shoulder 64 pressing against internal shoulder 65 of fishing neck tubular extension 43, and annular boss 66 in ball 39 lock-maintaining alignment. Movement of the fishing neck member 32 and tube extension 43, downward-relative to hanger housing 25, from the relationship of FIG. 5-to the lock set state of FIG. 3, simultaneously cams lugs 27, outwardly from the withdrawn, unlock state of FIG. 5 to the outwardly-extended, lock set state of FIGS. 1 and 3. Slot openings 67 and 68 are provided through hanger housing 25 and sleeve bearing 45, respectively, that act as a cage for lugs 27, guiding relative cammed inward and outer movement thereof. Please note that inner, upper corners and outer, lower corners of lugs 27 are beveled at 30°, and that the other lug corners are beveled at 45°, to attain desired camming interaction operation between camming surfaces.

When no-go bomb hanger 20 release is desired from the lock set state of FIGS. 1 and 3, a pulling tool 38 with a bottom member 69 pushes down on the top 70 of the upper extension 71 of lock member 63, that extends up to within cylinder 40, above surface 41. Extension 71 is a round rod extension, slidable through opening 51 within section 48 of fishing neck extension 43. The resulting downward movement of lock member 63 brings the reduced-diameter shank 72 on member 63, between cam surface 62 and shoulder 64, low enough that balls 39 are free to be cammed out of retainer openings 59, with upward movement of tube section 49 and lock member 63 together as weight of the pulling tool 38 is lessened, so resilient force of spring 56 can push the lock member 63 and tube 49 upward, together with balls 39, to the release state of FIG. 5. In this state, lugs 27 have been cammed from nipple recess 28, and the bomb hanger 20, with tooling 29, is being raised up the well tubing. Fluid flow passage 73, extended from the bottom of lock member 63 to side openings 74 and 75, helps relieve fluid pressure build-up in internal chambers (with relative movement between bomb hanger parts).

The no-go bomb hanger 80 embodiment of FIG. 6 is similar in many respects to the bomb hanger 20 of FIGS. 1 through 5, and components, the same, are numbered the same; or, if a little different, given primed numbers as a matter of convenience. With the hanger 80 embodiment, shoulders 24′ of hanger housing 25′ are the shoulders that come to rest on tubing no-go nipple shoulder 26. Resiliently compressible coil spring 56′, contained within housing 25′ is restrained between lock member 63′0 annular boss 81 and housing internal shoulder 82, just above the lower, internally- threaded 83 suspended-tool connective end 84. The fishing neck 32′ is formed with n enlarged-diameter shank 44, just below the cylindrical portion 40′ thereof, slidingly received in opening 85 of housing 25′, and terminated in a lower end 30° sloped, conical cam surface 47′. The conical cam surface extends down to openings 48′ in reduced-diameter bottom tubular section 49′, permitting retraction of lugs 27 to the withdrawn, unlocked state from the extended lug 27 locked, shank 44 -backed state shown in FIG. 6. It is of interest to note that two guide and limit pins 54′, held seated in place by jam screws 55′, project into guide slots 53′ of bottom tube 49′ at a location above the balls 39, rather than below, as the case with pin 54 in the FIGS. 1 – 5 embodiment. Further, the ball 39, retainers 60′, with conical recesses 59′ are held seated in place by jam screws 86 for lock member 63′ ball interference lock as backed by shank section 87 that is terminated in ball cam section 62′. Cam section 62′ extends to the upper rod extension 88 that extends to upper rod end 70. With this embodiment, as the fishing neck 32′ is lowered from its upper position to its lower, lock set position, shown—as permitted by slots 53′ and pins 54′—the lock member 63′ is carried down with tube 49′. This movement continues until balls 39 cam, outwardly, releasing lock member 63′ to shift upward, as urged by spring 56′, with shank section 87 locking the balls 39 in the interference position lock state, and lugs 27 are locked out, in the position set state as backed by shank 44. Then when bomb hanger release is desired, a pulling tool 38, as with the embodiment of FIGS. 1 – 5, is employed to press down on the top end 70 of lock member 63′, lowering lock member 63′ until balls 39 are permitted to cam out of conical recesses 59′. Then tube 49′ of fishing neck 32′, along with lock member 63′ and balls 39, may be raised relative to housing 25′, as urged by spring 56′ and/or as assisted by pulling force of a pulling tool, pulling upward on boss 34 of fishing neck 32′. This results in fishing neck shank 44 being pulled up from lug 27 backing alignment, and with continued upward pulling by a pulling tool 38 (seen in FIG. 5), lugs 27 are cammed inward from their outer set position and the bomb hanger 80 is then free to be pulled up the well.

Referring now to the no-go bomb hanger 90 embodiment of FIGS. 7, 8, and 9, a unit is presented utilizing interference lock balls 91 ad 92 at two closely spaced levels in the structure. The bomb hanger 90 has a generally triangular-shaped body housing 93, triangular shaped to facilitate oil and/or gas flow-by and device lowering, with lugs 27′ guided for inward and outward movement in openings 94 of each housing triangular apex. Further, body housing 93 has an upper fishing neck extension 95 wit a top external boss 96 engageable by appropriate wireline running and pulling tool 97 equipment for landing housing shoulder 24″ on, and raising from, a tubing no-go shoulder 26 (FIG. 1). An internally threaded 98 suspended tool connective member 99 is threaded 100 into the bottom of body housing 93, and in turn, is assembled to cylindrical ball retainer 101 by threaded connection 102. Resiliently compressible coil spring 103 is confined within the inner cylindrical opening 104 of housing 93, outside the outer surface 105 of ball retainer 101, and between the top 106 of member 99 and the bottom 107 of cylindrical member 108, slideably contained within housing opening 104. Member 108 is a lug 27′ camming and position lock member with a cam surface ended external annular recess 109 and cam surface ended ball internal recesses 110 and 111. Cylindrical ball retainer 101, in addition to ball retainer cage openings 112 and 113 for balls 91 and 92, respectively, is formed with an upper internal bore 114 and a lower bore 115, separated by an internal annular boss 116. A lock member assembly 117 has an upper head 118 movable into ball set position lock backing alignment, that is shown in FIG. 7 as being in the set state, with balls 91 and 92 held in interference fit in openings 112 and 113 of retainer 101, and ball recesses 110 and 111 of cylindrical member 108. This set state is with lugs 27′ cammed out of annular recess 109, to the extended cylinder member 108 back-locked condition of FIG. 7.

The head 118 of lock member 117 is assembled via a rod stem 119 to a lower head 120 that may be threaded to, or a press fit on, the lower end of rod stem 119 (assembly detail not shown), with the rod 119, a sliding fit through opening 121 of boss 116. Resiliently compressible coil spring 122 is contained between rod 119 and retainer 101 in bore 114, compressed between boss 116 and head 118 to normally urge the lock member 117 to its topmost position, with lower head 120 in abutment with the bottom of boss 116. A pulling and/or running tool bottom member 69′ may, with shifting of the lock member 117, achieve the ball 91 and ball 92 repositioned state of FIG. 9, with the lugs 27′ cammed inward to the withdrawn annular recess 109 seated state for running or pulling in or out of the well. In this embodiment, the corners of lugs 27′ are 45° cam bevels but could be formed at any suitable angle.

The no-go bomb hanger 130 of FIG. 10 and 11 is substantially the same (especially internally) as the embodiment of FIGS. 7, 8 and 9, and elements, the same, are numbered the same and not explained again; and those, slightly different, are given priming, as a matter of convenience. Here, the cylindrical member 108′ is provided with a bottom external boss 131 stop, with a stop shoulder 132 in housing member 93′, instead of a top end stop, as with the FIG. 7 embodiment. Further, the housing 93′ is provided with an internal boss 96′, equipped fishing neck extension 95′, and could have a generally triangular housing section, as in FIG. 8; or could be two-sided, like the housing of the FIGS. 1 – 5 embodiment.

With the no-go bomb hanger 140 of FIGS. 12 and 13, many internal details are the same as with the FIGS. 7 – 9 embodiment, and with the FIGS. 10 and 11 embodiment. Here, however, there is only one level of balls 141 that are shifted from one cam surface ended ball recess 110′ to the other recess 111′ in manipulation of the bomb hanger 140 between the run, or pull lug 27′λ withdrawn state of FIG. 12, to the set lock state of FIG. 13. It is of interest to note that the recess 111′ is deeper than recess 110′ in the cylindrical member 108″, and that as a result, the pulling and/or running tool member 69″ is provided with a two-diameter 142 and 143 end to properly accommodate the balls 141 in manipulation of the hanger 140, between the states of FIG. 12 and 13.

Referring again to the embodiment of FIG. 1 – 5, or of FIG. 6, when setting the bomb hanger in a well, the weight of the tool string is applied to the fishing neck member 32 or 32′, to cause the lugs 27 to be lockingly engaged in the recess 28 of the landing nipple. To release the running tool from the bomb hanger and leave the hanger thus locked in the well, the tools are lifted sufficiently to compress the spring 36*a* of the running tool 36, and then forcing the running tool from the fishing neck 32 against the resistance of collet bosses 35.

When setting the bomb hanger of FIGS. 7 – 9, or FIGS. 10 and 11, or FIGS. 12 and 13, it is only necessary to set the weight of the tools down to cause locking of the bomb hanger in the nipple and then lift the tools as gently as desired. They will lift free without resistance and without jarring the instrument or tool suspended from the bomb hanger.

Whereas this invention is herein illustrated and described with respect to several particular embodiments thereof, it should be realized that various changes may be made without departing from the essential contributions to the art made by the teachings hereof.

We claim:

1. A well equipment hanger constructed for engaging a no-go shoulder in well tubing and settable in place in a well including: housing means; lug lock means slidably mounted in slot means of said housing means for guided movement between an inner withdrawn state and an outward position; cam member means mounted for longitudinal sliding movement within said housing, shaped to cam said lug lock means through the range of movement from said inner and withdrawn state to the outward position; interference lock means positionable for locking said cam means from movement relative to said housing means and in position to back said lug lock means in said outward position; locking member means positionable for unlock moving said interference lock means from the interference lock state to a lock release position; wherein said locking member means is a resiliently displaceable plunger structure; and spring means resiliently longitudinally biasing said plunger in one direction throughout its range of longitudinal movement.

2. The well equipment hanger of claim 1, wherein said resiliently displaceable plunger structure is slidably contained within said tubular extension.

3. The well equipment hanger of claim 1, wherein said cam member means is a tubular extension of an upper end fishing neck formed with a chamber having an annular boss at the top for engagement by running tools and pulling tools; and said locking member means resiliently displaceable plunger structure includes an upper rod extension extending upward into the chamber of said fishing neck for engagement by a pulling tool and depression of the locking member means downward for interference lock means release and cam member means movement for lock lug means release.

4. The well equipment hanger of claim 1, wherein said housing means is formed with an upper end fishing neck portion having a chamber and an upper annular boss for engagement by running tools and pulling tools.

5. The well equipment hanger of claim 1, wherein said housing means is formed with two parallel spaced sides; and extending between the two paralled spaced sides, arcuate sections; and with said housing having two shoulders extending through said arcuate sections, spaced to seat on a no-go shoulder in well tubing.

6. The well equipment hanger of claim 5, with said lug lock means positioned to extend into a tubing nipple recess when said hanger is seated on a no-go shoulder in well tubing.

7. The well equipment hanger of claim 1, wherein cooperating guide pin means and slot means guide said cam member means and limit the range of longitudinal movement of said cam member means within said housing means.

8. The well equipment hanger of claim 7, wherein said guide pin means is mounted in said housing means; and said slot means is in said cam member means.

9. The well equipment hanger of claim 8, wherein said guide pin means is a single pin, mounted to extend through said slot means in the cam member means.

10. The well equipment hanger of claim 9, wherein said single pin extends through a spring retainer contained within said tubular extension.

11. The well equipment hanger of claim 8, wherein said guide pin means comprises a plurality of pins mounted in said housing to extend into said slot means in said cam member means; and with said slot means a plurality of slots in the cam member means.

12. The well equipment hanger of claim 11, wherein said spring means resiliently longitudinally biasing said plunger is a coil spring seated at one end on shoulder means within said housing means.

13. The well equipment hanger of claim 1, wherein said cam member means is a tubular extension from an upper fishing neck member.

14. The well equipment hanger of claim 13, wherein said interference lock means are lock position balls held in ball cage openings in a section of said tubular extension having a wall thickness of less than the diameter of said balls; with ball recess means in said housing means; with said plunger structure being formed with, and enlarged diameter portion a snug sliding fit in the section of said tubular extension having a wall thickness of less than the diameter of said balls; a smaller diameter portion above said enlarged diameter portion; and a ball cam surface between the different diameter portions of said plunger structure.

15. The well equipment hanger of claim 14, wherein when said lock position balls have been cammed to seat in said ball recess means in said housing means an enlarged diameter portion of said tubular extension is in position backing said lug lock means in the outward position.

16. The well equipment hanger of claim 15, with said tubular extension being formed with a recessed section permitting movement of said lug lock means to the inner withdrawn state; and cam surface means between and separating said recessed section and said enlarged diameter portion of said tubular extension.

17. The well equipment hanger of claim 16, wherein said lug lock means is a plurality of lugs having beveled upper and lower corners.

18. The well equipment hanger of claim 11, wherein the slope of the inner, upper bevel of said lugs matches the slope of said cam surface means between said recessed section and said enlarged diameter portion of the tubular extension.

19. The well equipment hanger of claim 17, wherein the slope of the inner, upper bevel and the outer, lower bevel of said lugs is approximately 30°.

20. The well equipment hanger of claim 19, wherein the outer, upper bevel and the inner, lower bevel of said lugs are angled at approximately 45°.

21. The well equipment hanger of claim 1, wherein said cam member means is a tubular member slidably contained within said housing means; tubular sleeve means connected at the bottom end to said housing; said interference lock means are lock position balls held in ball cage openings in a section of said tubular sleeve means having a wall thickness less than the diameter of said balls.

22. The well equipment hanger of claim 21, with ball recess means in said tubular member.

23. The well equipment hanger of claim 22, wherein said resiliently displaceable plunger structure is slidably contained within said tubular sleeve means.

24. The well equipment hanger of claim 23, wherein said ball recess means in said tubular member are in the form of two closely spaced annular internal grooves with cam beveled sides.

25. The well equipment hanger of claim 24, wherein there are two levels of balls and ball cage openings in said tubular sleeve means; and with spacing between the two levels of balls and ball cage openings substantially the same as spacing of said closely spaced annular internal grooves.

26. The well equipment hanger of claim 24, wherein one of said two closely spaced annular internal grooves is a deeper groove than the other.

27. The well equimpment hanger of claim 26, wherein there is one level of balls and ball cage openings in said tubular sleeve means.

28. The well equipment hanger of claim 22, wherein said tubular member is slidable on said tubular sleeve means between lug means lock set and release limit positions; and resiliently compressed spring means seated on housing fixed structure means resiliently longitudinally biasing said tubular member in the direction of said lug means lock set limit position.

29. The well equipment hanger of claim 28, wherein said lug lock means is a plurality of lugs having beveled upper and lower corners.

30. The well equipment hanger of claim 29, wherein said housing means is generally triangular with a lug extendable to project from each apex of the triangle.

31. The well equipment hanger of claim 30, wherein said housing has three shoulders spaced to seat on a no-go shoulder in well tubing.

* * * * *

UNITED STATES PATENT OFFICE

CERTIFICATE OF CORRECTION

Patent No. 4,023,620 Dated May 17, 1977

Inventor(s) Imre I. Gazda and Albert W. Carroll

It is certified that error appears in the above-identified patent and that said Letters Patent are hereby corrected as shown below:

Column 1, line 9, "use" should be --used--.

Column 3, line 67, "block" should be --lock--.

Column 5, line 34, "ad" should be --and--.

Column 6, line 40, after "27' " delete lambda Greek symbol.

Column 8, line 17, "and" should be --an--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*